US010866030B2

(12) United States Patent
Sobolak et al.

(10) Patent No.: US 10,866,030 B2
(45) Date of Patent: Dec. 15, 2020

(54) HEAT EXCHANGER

(71) Applicant: Hamilton Sundstrand Corporation, Charlotte, NC (US)

(72) Inventors: Piotr Sobolak, Slupsk (PL); Pawel Banach, Lublin (PL)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 51 days.

(21) Appl. No.: 16/246,607

(22) Filed: Jan. 14, 2019

(65) Prior Publication Data

US 2019/0234690 A1 Aug. 1, 2019

(30) Foreign Application Priority Data

Feb. 1, 2018 (EP) ..... 18461513

(51) Int. Cl.

| | |
|---|---|
| ***F28D 3/00*** | (2006.01) |
| ***F28D 9/00*** | (2006.01) |
| ***F28F 3/08*** | (2006.01) |
| ***F28D 7/10*** | (2006.01) |
| *F28D 21/00* | (2006.01) |

(52) U.S. Cl.

CPC ..... *F28D 9/0093* (2013.01); *F28D 7/103* (2013.01); *F28D 9/0012* (2013.01); *F28D 9/0018* (2013.01); *F28D 9/0037* (2013.01); *F28F 3/086* (2013.01); *F28D 2021/0021* (2013.01); *F28D 2021/0026* (2013.01); *F28F 2215/10* (2013.01)

(58) Field of Classification Search

CPC ..... F28F 9/0093; F28F 7/103; F28F 9/0012; F28F 9/0018; F28F 9/0037; F28F 2021/0021; F28F 2021/0026; F28F 3/086; F28F 2215/10

USPC ..... 165/166

See application file for complete search history.

(56) References Cited

U.S. PATENT DOCUMENTS

| | | | |
|---|---|---|---|
| 3,016,384 | A | 1/1962 | Caliezi |
| 4,096,616 | A | 6/1978 | Coffinberry |
| 6,968,892 | B1 | 11/2005 | Symonds |
| 7,111,672 | B2 | 9/2006 | Symonds |

(Continued)

FOREIGN PATENT DOCUMENTS

| | | | |
|---|---|---|---|
| EP | 2924385 | A1 | 9/2015 |
| EP | 3026384 | A2 | 6/2016 |

(Continued)

OTHER PUBLICATIONS

Extended European Search Report for International Application No. 18461513.6 dated Aug. 1, 2018, 5 pages.

*Primary Examiner* — Davis D Hwu

(74) *Attorney, Agent, or Firm* — Cantor Colburn LLP

(57) ABSTRACT

A plate for use in a heat exchanger is includes: a first surface; a second surface; first, second and third discrete flow passages passing through the plate from the first surface to the second surface, the second flow passage extending around the first flow passage and the third flow passage extending around the second flow passage. A plurality of fins extend parallel to the first surface across the third flow passage and have a first surface extending parallel to the first surface of the plate and a second surface extending parallel to and spaced from the first surface of the fin; and one or more pins protruding from the first surface of at least some of the fins. The pins extend away from the second surface of the fins.

15 Claims, 8 Drawing Sheets

(56) References Cited

U.S. PATENT DOCUMENTS

| | | | | |
|---|---|---|---|---|
| 2004/0112579 | A1* | 6/2004 | Strahle | F28F 9/0075 165/166 |
| 2006/0151147 | A1 | 7/2006 | Symonds | |
| 2009/0145581 | A1 | 6/2009 | Hoffman et al. | |
| 2013/0042612 | A1* | 2/2013 | Shapiro | F28D 7/06 60/641.7 |
| 2014/0026577 | A1* | 1/2014 | Reinke | F01K 13/006 60/670 |
| 2015/0184539 | A1 | 7/2015 | Maier | |

FOREIGN PATENT DOCUMENTS

| | | | |
|---|---|---|---|
| EP | 3026384 | A3 | 6/2016 |
| EP | 3249334 | A1 | 11/2017 |

* cited by examiner

HEAT EXCHANGER

FOREIGN PRIORITY

This application claims priority to European Patent Application No. 18461513.6 filed Feb. 1, 2018, the entire contents of which is incorporated herein by reference.

TECHNICAL FIELD

The present disclosure relates to heat exchangers and to a plate for use in a heat exchanger.

BACKGROUND

Heat exchangers are typically used to transfer heat from one medium to another. In the aerospace industry, heat exchangers can be used for example to heat fuel before being combusted in a turbine engine and to cool or heat air for use, for example, in conditioning aircraft wings or cooling parts of turbine engines.

There is a need to provide a low weight, high strength heat exchanger for heat exchange between three or more fluid flows which can be manufactured to a desired size and shape whilst providing efficient heat exchange between the fluids.

The present disclosure seeks to address these challenges.

SUMMARY

According to an aspect of the present disclosure there is provided a plate for use in a heat exchanger, the plate comprising: a first surface; a second surface extending parallel to and spaced from the first surface; first, second and third discrete flow passages passing through the plate from the first surface to the second surface, the second flow passage extending around the first flow passage and the third flow passage extending around the second flow passage; a plurality of fins extending parallel to the first surface across the third flow passage and having a first fin surface extending parallel to the first surface of the plate and a second fin surface extending parallel to and spaced from the first fin surface; and one or more pins protruding from the first fin surface of at least some of the fins, the pins extending away from the second fin surfaces, wherein a first distance from the second fin surfaces to an end of the pins removed from the first fin surfaces is less than or equal to a second distance from the second surface of the plate to the first surface thereof.

It will be understood that the first, second and third flow passages each extend through the plate. The plate can be relatively simply manufactured and can then be assembled with other plates to form a heat exchanger matrix without the need for any further machining. Further, the shape of the plate and the passages within it can be varied as required to provide a heat exchanger matrix having an optimum shape and performance for a desired use.

The number and form of the fins can also be varied to optimise heat exchange performance for a desired used.

In one preferred example, at least one pin may be provided on the first fin surface of each of the fins.

The plate may be made from any suitable material. In preferred examples, the plate is made from metal.

The first flow passage could extend through the centre of the plate, however the plate may further comprise a solid central portion extending from the first surface to the second surface, and the first flow passage may extend around the solid central portion. The solid central portion may increase the strength of the plate and improve the heat exchange efficiency when used in a heat exchanger.

In any example of the present disclosure, the plate may further comprise a plurality of second fins extending across the first flow passage from the solid central portion towards the second flow passage. The second fins may further improve the strength of the plate and the heat exchange capacity of the heat exchanger when assembled.

In any example of the present disclosure, the second fins may have an undulating form. In one preferred example, the fins may undulate parallel to the second surface of the plate along the length of the second fins. The undulating form may increase the turbulence in the fluid flowing through the first flow passage in use, thus improving the heat exchange efficiency of the heat exchanger when assembled.

In any example of the present disclosure, the pins may be twisted in a direction perpendicular to the direction of the flow of fluid through the third flow passage in use. This again may increase the turbulence in the fluid flowing through the third flow passage in use, thus improving the heat exchange efficiency of the heat exchanger when assembled.

In any example of the present disclosure, the third flow passage may comprise a gap formed by a wall extending outwardly of and around the second flow passage, and first and second outer portions formed by walls extending outwardly from the wall and re-joining therewith on either side thereof, wherein the sections of the wall which are internal of the first and second outer portions extend over a third distance which is less than the second distance from the first surface to the second surface of the plate, and the other sections of the wall and the walls extending outwardly from the wall on either side thereof extend from the first surface to the second surface of the plate.

Although the wall could take many forms depending on the use for which the plate and heat exchanger were designed, such as for example an elliptical shape, in one preferred example the wall may comprise an annular ring.

In any example of the present disclosure, the plate may be formed by etching, or any method by which sections of the plate are removed to form the required shape, such as, for example, chemical etching. Alternatively, the plate may be formed by additive manufacturing, 3D printing or powder metallurgy.

The plate and the flow passages could take many possible forms. In any example of the present disclosure however, the first and second flow passages may be curved, e.g. elliptical. In a more preferred example however, the first and second flow passages may be annular in shape. The curved shape of the first, second and/or third flow passages will result in increased strength of the plate and of the heat exchanger when assembled.

From a further aspect, the present disclosure may provide a heat exchanger body comprising a number of plates as claimed in any preceding claim, wherein the plates are arranged adjacent to one another along a longitudinal axis of the heat exchanger such that the first surface of a first plate is in contact with and fixed to the second surface of an adjacent plate, and the first, second and third flow passages of adjacent plates are joined together to form continuous first, second and third flow passages extending through the heat exchanger body.

In a preferred example of the present disclosure, adjacent plates may be joined together by brazing. This may provide fluid tight joins between the plates in each of the first, second and third flow passages.

The heat exchanger body of the present disclosure may further comprise: a first inlet to the first flow passage provided at a first longitudinal end of the heat exchanger body and a first outlet from the first flow passage provided at a second longitudinal end of the heat exchanger body; and a second inlet to the second flow passage provided at the second longitudinal end of the heat exchanger body and a second outlet from the second flow passage provided at the first longitudinal end of the heat exchanger body such that in use, fluid will flow through the second flow passage in a direction opposite to the direction of flow of fluid through the first flow passage.

The heat exchanger body of the present disclosure may further comprise: a third inlet to the third flow passage provided at the first longitudinal end of the heat exchanger body and a third outlet from the third flow passage provided at the first longitudinal end of the heat exchanger body.

The third inlet may be provided on a first side of the heat exchanger body and the third outlet may be provided on a second opposite side of the heat exchanger body such that in use, fluid will flow through the third flow passage in the first longitudinal direction on the first side of the heat exchanger body, flow around the second passage in a direction perpendicular to the first longitudinal direction, and then flow through the third flow passage to the outlet in the second longitudinal direction on the second side of the heat exchanger body.

From a further aspect of the present disclosure there is provided a method of exchanging heat between fluid flows, the method comprising: passing a first fluid flow in a first direction through a first flow passage extending through a plurality of plates in a heat exchanger body; passing a second fluid flow in a second direction opposite to the first direction through a second flow passage extending around the first flow passage through the plurality of plates in the heat exchanger body; and passing a third fluid flow through a third flow passage extending around the second flow passage through the plurality of plates in the heat exchanger body.

The direction of heat exchange between the first, second and third fluid flows may be altered by varying the rate of fluid flow through the heat exchanger. This can be advantageous in various applications, such as in a gas turbine engine where generator oil is initially required to be heated but is then required to be cooled after a predetermined time period has elapsed.

Preferably therefore, the method further comprises altering the rate of flow of at least one of the first, second and third fluid flows through the first, second and third flow passages from a first flow rate to a second flow rate so as to change the direction of heat exchange between the first and second fluids and/or between the second and third fluids.

From a further aspect of the present disclosure there is provided a method of manufacturing a heat exchanger, the method comprising: forming a plurality of plates as claimed in any of claims 1 to 7; and stacking the plurality of plates one adjacent the other in a desired configuration so as to align the first, second and third flow passages in the plurality of plates.

The method may further comprise joining the plates together by brazing.

The plurality of plates may vary in shape and may be stacked so as to form a heat exchanger body having an irregular shape. This may allow as effective and light weight a heat exchanger as possible to be made to fit to a confined space when necessary.

Features of any example described herein may, wherever appropriate, be applied to any other examples of the present disclosure. Where reference is made to different examples, it should be understood that these are not necessarily distinct but may overlap.

BRIEF DESCRIPTION OF THE FIGURES

One or more non-limiting examples will now be described, by way of example only, with reference to the accompanying drawings, in which.

DETAILED DESCRIPTION

Figure 1:
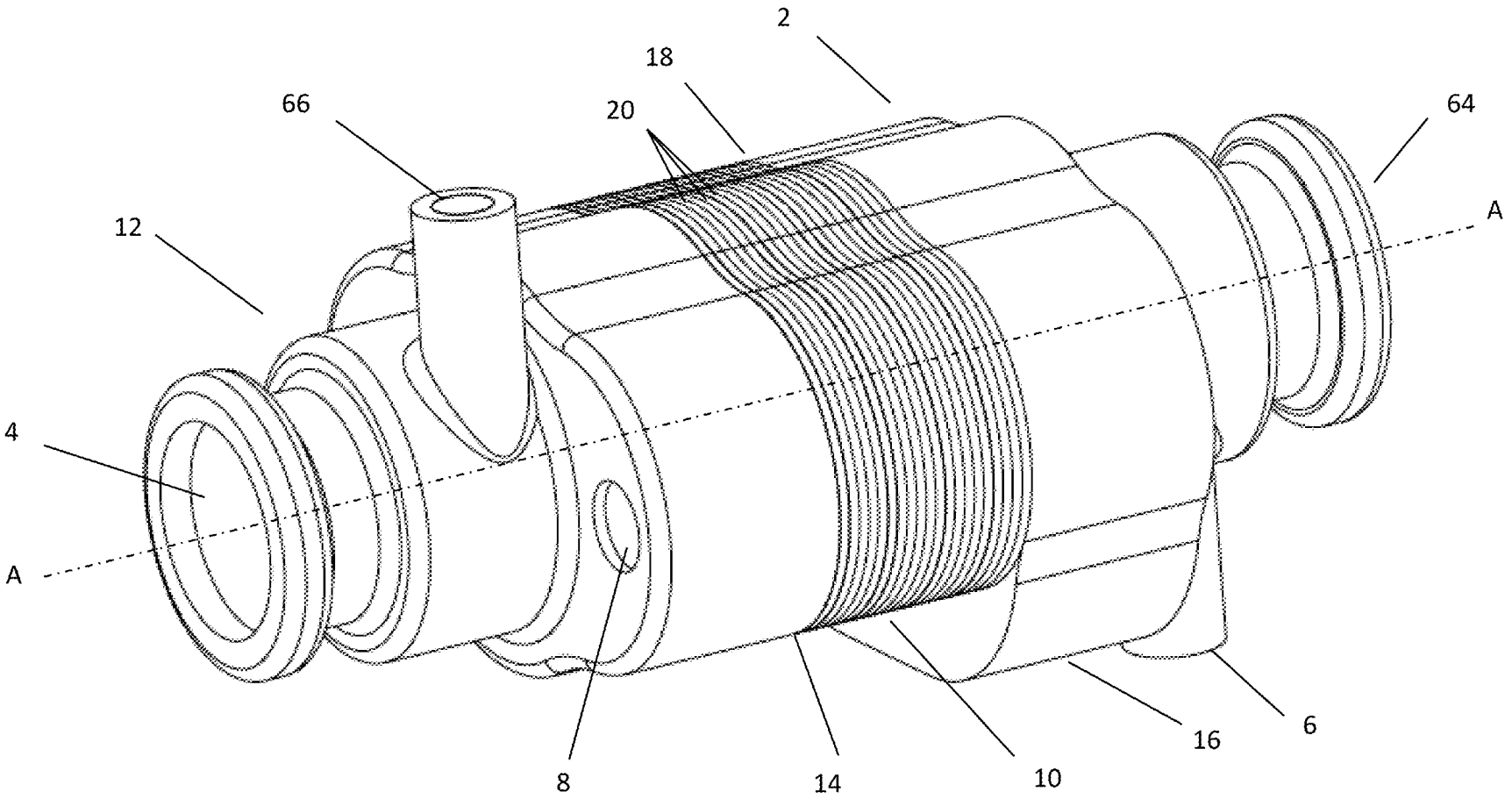
FIG. 1 is an isometric view of a heat exchanger according to an example of the present disclosure.
Figure 2:
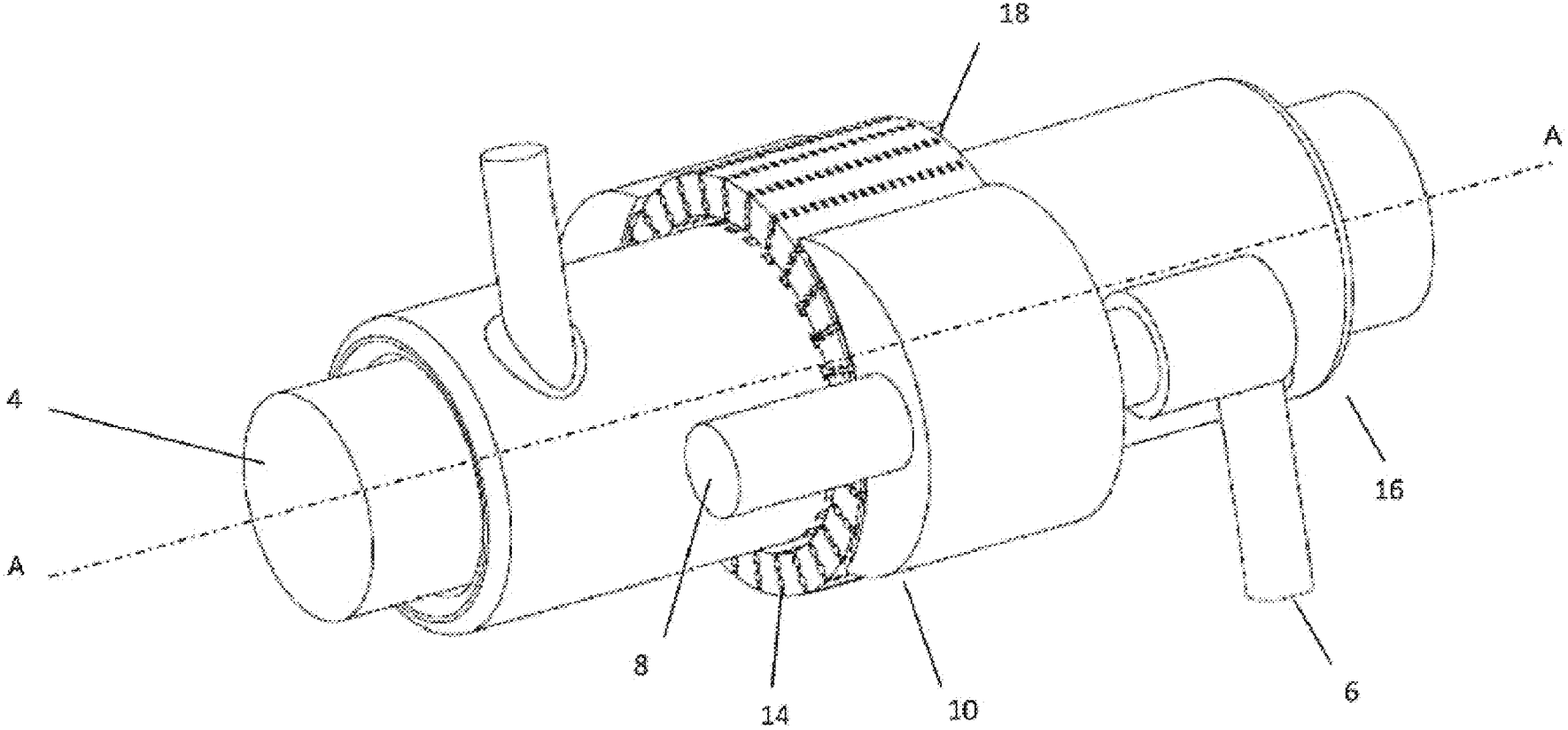
FIG. 2 is an isometric view of the interior of the heat exchanger of FIG. 1.

FIG. 1 is an isometric view of a heat exchanger 2 according to an example of the present disclosure. As can be seen in FIGS. 1 and 2, the heat exchanger 2 is a three way heat exchanger, having a first inlet 4 for receiving a first fluid, a second inlet 6 for receiving a second fluid, and a third inlet 8 for receiving a third fluid. The heat exchanger 2 is configured to exchange heat between separate flows of the first and second fluids and between separate flows of the second and third fluids.

The heat exchanger 2 comprises a main body 10 extending about a central longitudinal axis A-A. The main body 10 is made up of a number of plates 20 as will be described in further detail below. A first tank 12 extends about the axis A-A away from the main body 10 in a first direction and is provided adjacent to a first longitudinal end 14 of the main body 10. A second tank 16 extends about the axis A-A away from the main body 10 in a second direction, opposite to the first direction, and is provided adjacent to the second longitudinal end 18 of the main body 10. The first and second tanks 12, 16 may be formed from any suitable metal (for example, aluminium which is suitable for aerospace applications due to its light weight) by casting or machining. The tanks 12, 16 may be fixed to the main body 10 of the heat exchanger 2 by brazing or welding.

Figure 3:
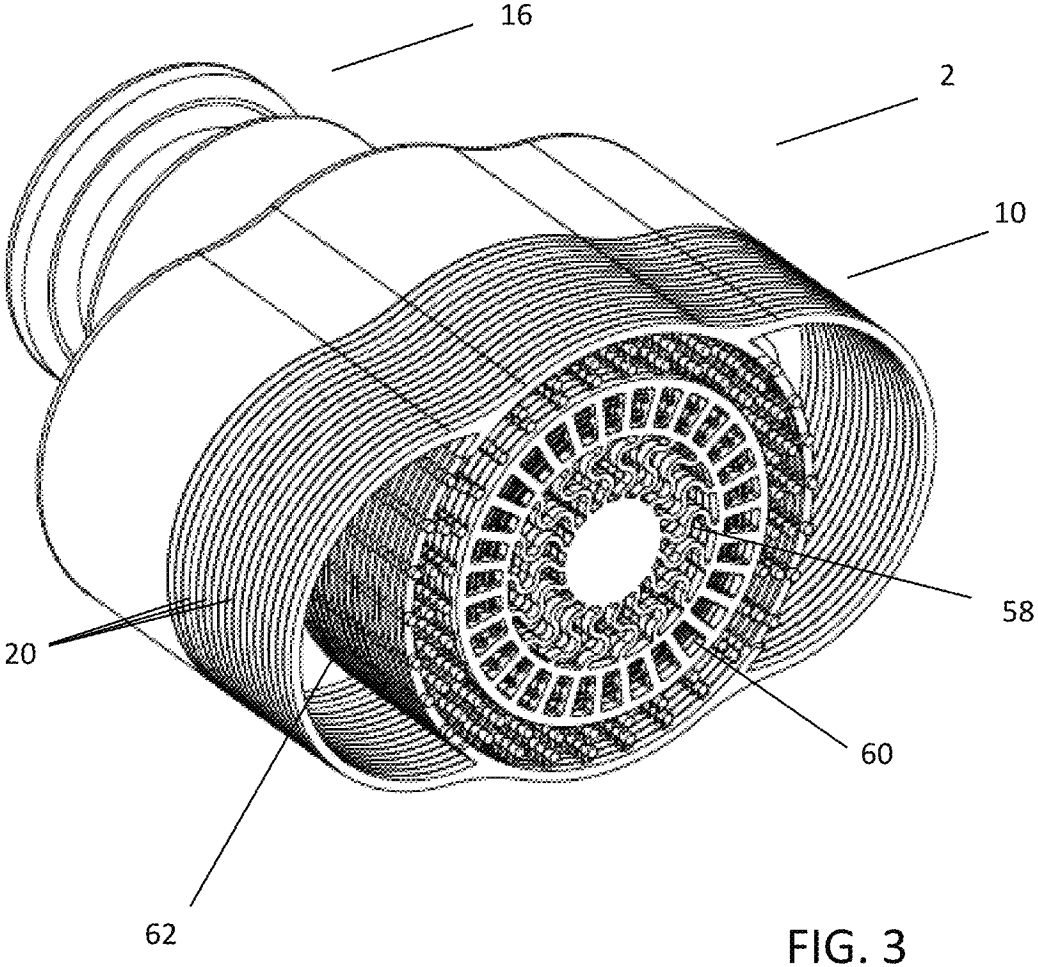
FIG. 3 is an isometric view of a cross section through the main body of the heat exchanger of FIG. 1.

As can be seen in FIG. 1 and shown in greater detail in FIG. 3, the main body 10 of the heat exchanger 2 according to examples of the present disclosure comprises a matrix made up of individual plates 20. In one example, the plates 20 can be made from aluminium. In alternative examples, the plates may be made from other metals such as for example, copper, stainless steel or nickel alloy. The plates can be formed by an etching process (such as for example, acid etching, photo etching, laser etching or spark etching)

by which portions of the plate are removed. Alternatively, the plates can be formed by being built up by 3D printing or by powder metallurgy.

Figure 4:
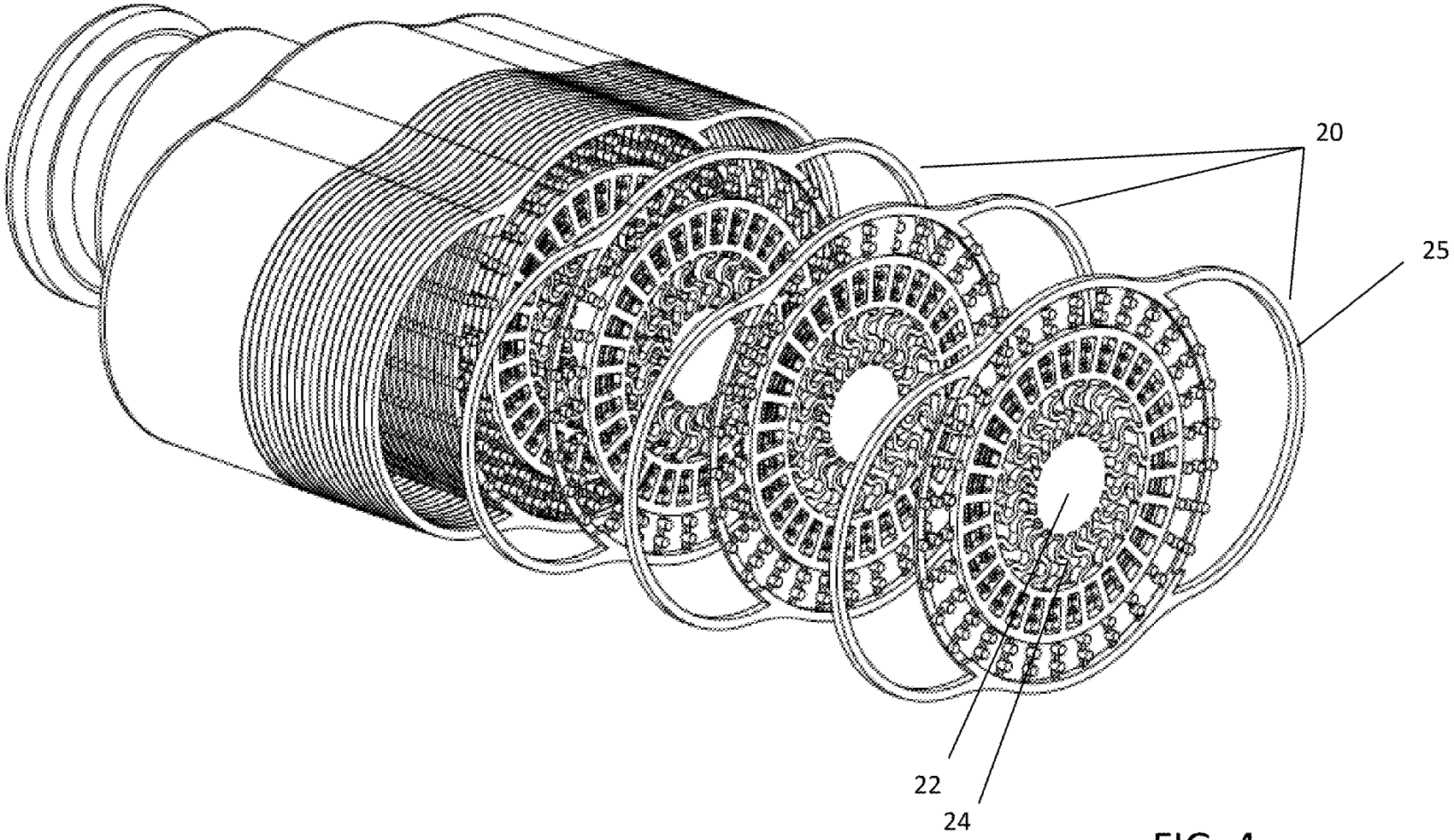
FIG. 4 is exploded similar view to FIG. 3 but showing some of the plates of the heat exchanger matrix in exploded view.
Figure 5A:
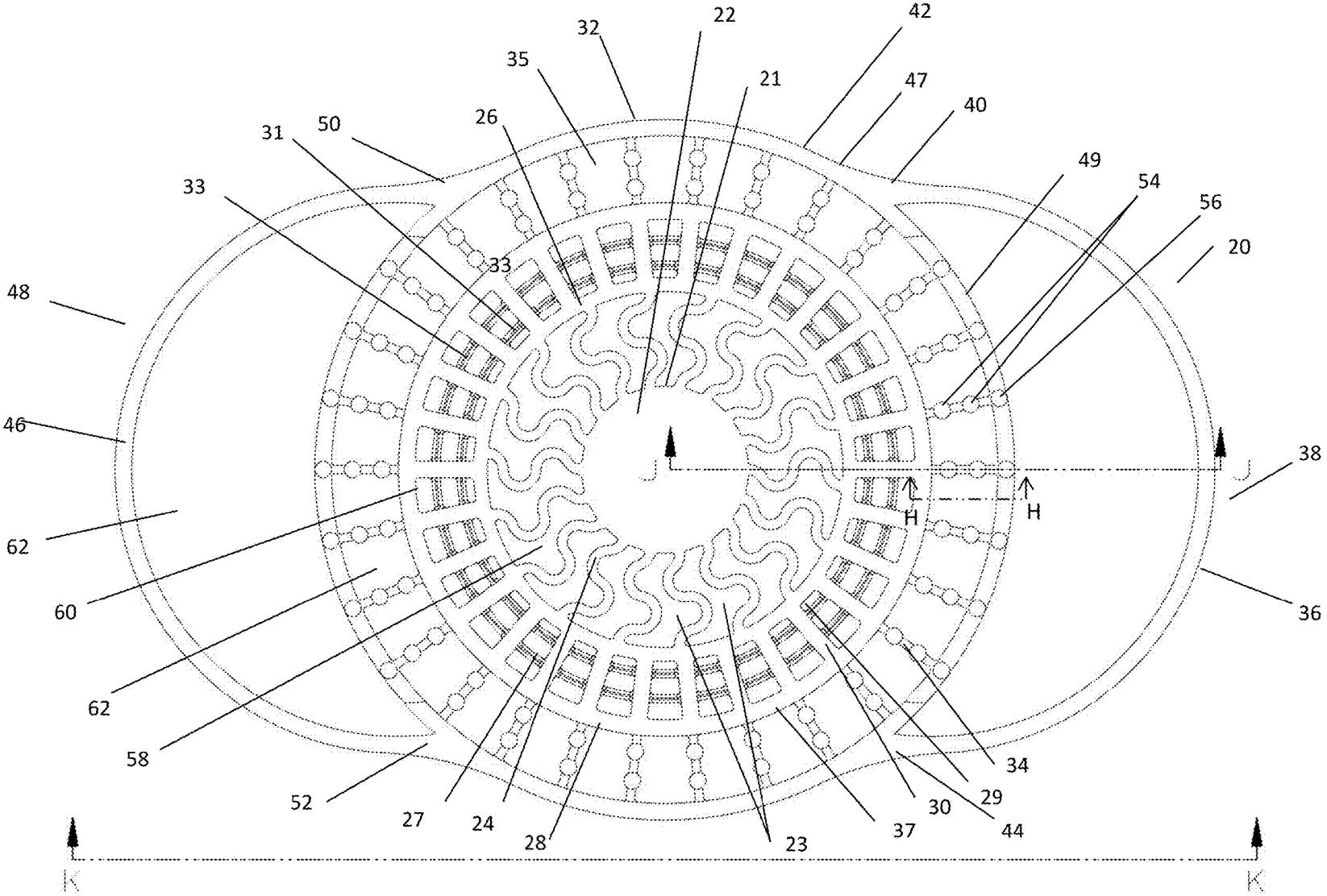
FIG. 5*a* is a top plan view of a single plate of the heat exchanger of FIG. 1.
Figure 5B:
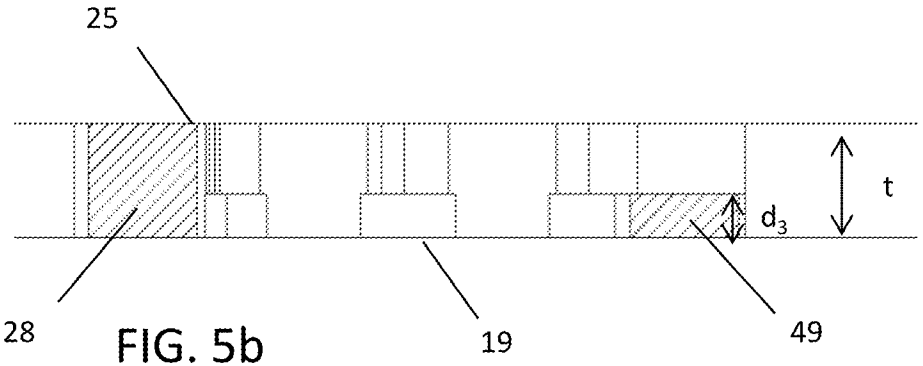
FIG. 5*b* is a section along line H-H of FIG. 5*a;*
Figure 5C:
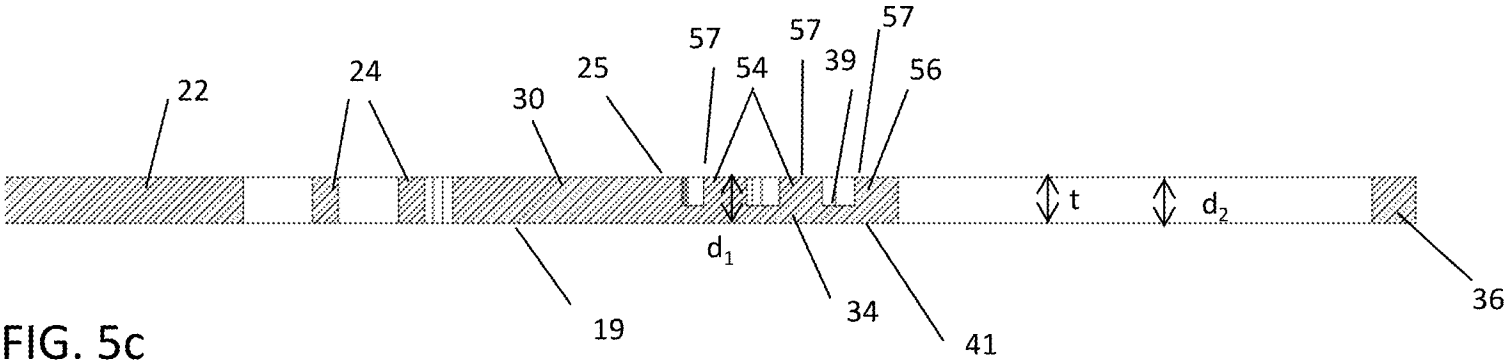
FIG. 5*c* is a section along line J-J of FIG. 5*a;*
Figure 5D:
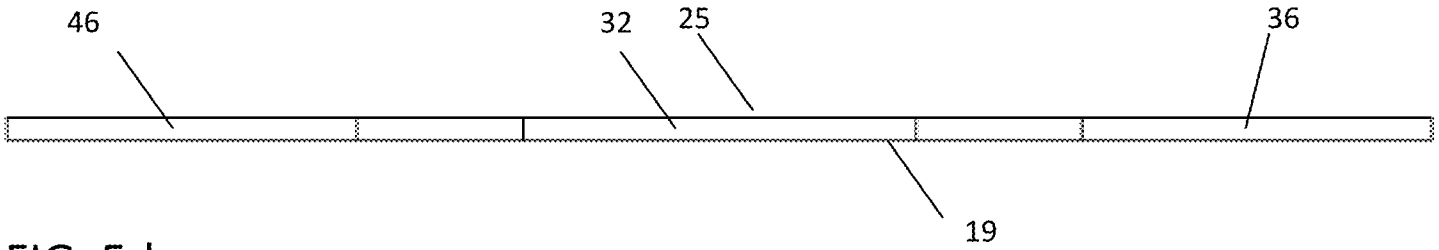
FIG. 5*d* is a section along line K-K of FIG. 5*a;*

As can be seen more clearly in FIGS. 4 and 5*a*, the shape of each plate 20 in top plan view comprises a solid central portion 22 which is circular in the example shown and has a thickness t (as seen in FIGS. 5*b* to 5*d*). Spokes or fins 24 extend radially outwardly from the circular portion 22 at regular intervals about the perimeter 21 thereof such that gaps or open areas 23 (forming a first flow passage 58) are left between the fins 24. In the example shown, 18 radial fins 24 are evenly distributed about the perimeter 21 of the circular portion 22. In the example shown, the radial fins 24 are not straight but rather take an undulating form, each fin 24 forming a wave having a single trough and a single peak. The number and shape of the fins can be varied depending on the heat exchange requirements of a particular application. In one example according to the present disclosure, the radial fins 24 are formed to extend over the full thickness (t) of the plate 20. It would however be possible for them to extend only over a part of the thickness t of the plate 20, for example having a thickness of t/2 and extending from the base or second surface 19 of the plate 20 towards the first surface 25 thereof.

At their radially outer ends, the fins 24 join with a first annular ring 26 which is concentric with the circular portion 22. A second annular ring 28 extends concentrically with and radially outwardly from the first annular ring 26 so as to form an annular gap 27 (forming a second flow passage 60) between the first and second annular rings 26, 28. The first and second annular rings 26, 28 are formed to extend over the full thickness t of the plate 20, having a thickness t in the example shown. Straight radial spokes or fins 30 extend between the first and second annular rings 26, 28. In the example shown, thirty straight radial fins 30 are evenly distributed about the perimeter 29 of the first annular ring 26 and extend from the second surface 19 of the plate 20 over the full thickness t thereof, having a thickness of t. Two further concentric annular rings 31, 33 extend over a part of the thickness of the plate, one inside the other in the gap 27 between the first and second annular rings 26, 28. In the example shown, the further concentric annular rings 31, 33 have a thickness of t/2 and extend from the second surface 19 of the plate 20.

A third annular ring or wall 32 is concentric with and spaced radially outwardly from the second annular ring 28 so as to form an annular gap or gap 35 (which forms part of a third flow passage 62) between the second and third annular rings 28, 32. The third annular ring 32 is formed to extend over the full thickness t of the plate 20, having a thickness tin the example shown. A further set of straight radial spokes or fins 34 extends between the second and third annular rings 28, 32. In the example shown, thirty straight radial fins 34 are evenly distributed about the perimeter 37 of the second annular ring 28.

A first substantially semi-circular rim or wall 36 is provided extending outwardly from a first side 38 of the third annular ring 32 and having a radius (not shown) which is less than the radius (not shown) of the third annular ring 32. Thus, as seen in the plan view of FIG. 5, a first end 40 of the first substantially semi-circular rim 36 joins the radially outer edge 42 of the third annular ring 32 on a radius (not shown) at approximately 30° from the vertical in a clockwise direction, or approximately $1/12^{th}$ of the distance around the radially outer edge 42 of the third annular ring 32. The second end 44 of the first substantially semi-circular rim 36 joins the radially outer edge 42 of the third annular ring 32 on a radius (not shown) at approximately 150° from the vertical, or approximately $5/12^{th}$ of the distance around the perimeter of the third annular ring 32. Thus the first substantially semi-circular rim 36 forms a first outer portion 63 of the third flow passage 62.

A second substantially semi-circular rim or wall 46 extends outwardly from the third annular ring 32 on a second side 48 thereof, opposite to the first side 38. The radius (not shown) of the second substantially semi-circular rim 46 is equal to the radius (not shown) of the first substantially semi-circular rim 36. As seen in the plan view of FIG. 5, a first end 50 of the first substantially semi-circular rim 36 joins the radially outer edge 42 of the third annular ring 32 on a radius (not shown) at approximately 330° from the vertical in the clockwise direction, or approximately $11/12^{th}$ of the distance around the radially outer edge 42 of the third annular ring 32. The second end 52 of the first substantially semi-circular rim 36 joins the radially outer edge 42 of the third annular ring 32 on a radius (not shown) at approximately 210° from the vertical, or approximately $7/12^{th}$ of the distance around the perimeter of the third annular ring 32. Thus the second substantially semi-circular rim 46 forms a second outer portion 65 of the third flow passage 62.

In the example shown, the first and second substantially semi-circular rims 36, 46 extend over the full thickness t of the plate 20, having a thickness t. The portions 47 of the third annular ring 32 which are not surrounded by the first and second substantially semi-circular rims 36, 46 also extend over the full thickness t of the plate 20, having a thickness t. The portions 49 of the third annular ring 32 which are internal of one of the first and second substantially semi-circular rims 36, 40, i.e. between the first and second ends 40, 44 of the first substantially semi-circular rim 36 or between the first and second ends 50, 52 of the second substantially semi-circular rim 46, extend over a distance $d_3$ which is only part of the thickness t of the plate 20 from the second surface 19 thereof, having a thickness of t/2 in the example shown.

In preferred examples, each plate 20 may have a thickness t of from about 0.5 mm to 5 mm. In the preferred example shown in FIGS. 3 to 5, the plate has a thickness of 0.5 mm. As described above, the thickness of the fins 24, 30, 34 in the described example is t/2. It will be appreciated that as the fins 24, 30, 34 act to strengthen the heat exchanger structure, the thickness of the fins may be determined to fulfil the strength requirements of a particular heat exchanger design. As is also shown in FIG. 5, pins 54, 56 which can be cylindrical in shape are provided on the further set of straight radial fins 34 extending perpendicular thereto and parallel to the longitudinal axis A of the heat exchanger 2. The height and shape of the pins 54, 56 is chosen to improve heat exchange efficiency. In alternative examples, the pins could be circular, elliptical or tear drop shaped in cross section. By twisting the pins in a direction perpendicular to the flow of fluid in use, turbulence in the fluid flow can be increased thus improving heat exchange capacity. In one example therefore, the use of a tear drop shape may promote turbulent flow of fluid thus improving heat exchange efficiency. In the preferred example shown, the pins have a height of t/2, such that the ends 57 of the pins 54, 56 furthest from the fins are level with the first surface of the plate 20. The pins 54, 56 provide a secondary heat exchange surface in use, the primary surface being provided by each set of fins 24, 30, 34, the central circular portion 22 and the annular rings 26, 28, 32.

In an alternative preferred example (not shown) some pins 54, 56 may be provided with a reduced height such that their ends 57 are below the first surface of the plate (20). Thus, in use, when the plates 20 are joined together, fluid will be able to flow over the ends 57 of these pins 54, 56 between adjacent stacked plates 20, thus further increasing turbulence in the fluid flow and potentially further improving the heat exchange capacity of the heat exchanger 2.

Figure 6A:
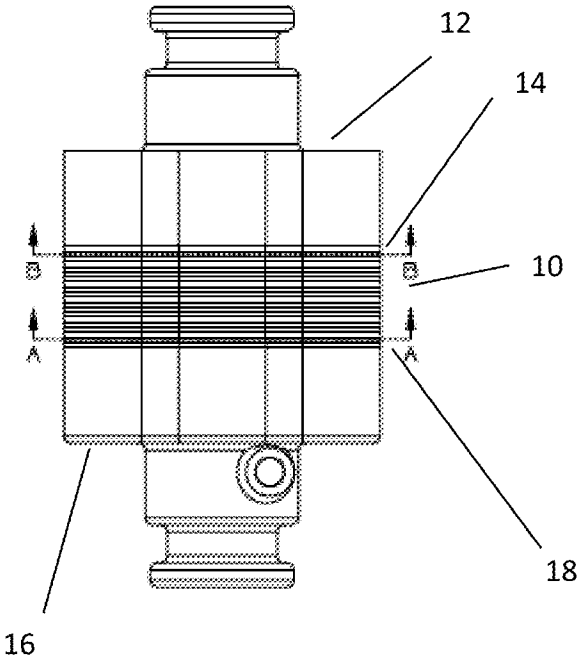
FIG. 6*a* is a side view of the heat exchanger of FIGS. 1 to 4.
Figure 6B:
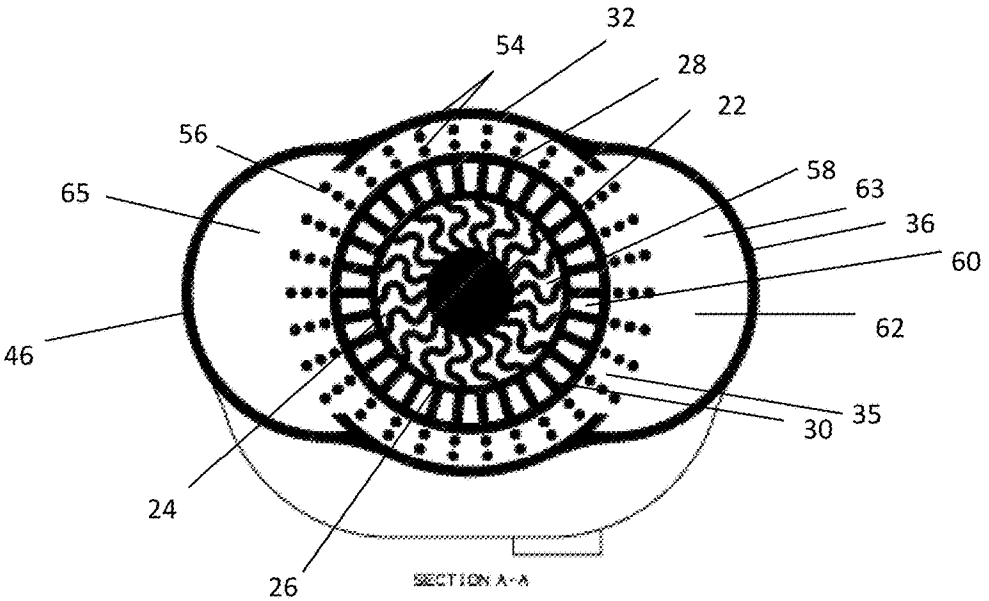
FIG. 6*b* is a section along line A-A of FIG. 6*a*.
Figure 6C:
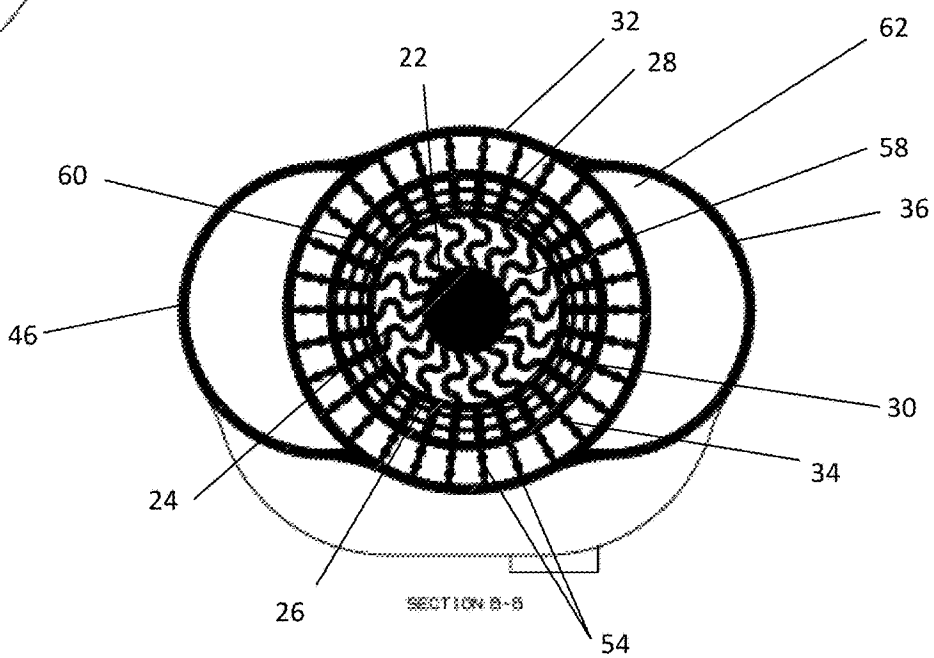
FIG. 6*c* is a section along line B-B of FIG. 6*a.*

As seen in FIG. 5*c*, the radial fins 34 have a first surface 39 which extends parallel to the first surface 25 of the plate, and a second surface 41 which is integral with and in the plane of the second surface 19 of the plate 20. FIGS. 6*b* and 6*c* are sections through a plate 20, FIG. 6*b* being a section at a height of greater than t/2 from the second surface 19 of the plate 20, and FIG. 6*c* being a section at a height of less than t/2 from the second surface 19 of the plate 20. As shown more clearly in FIGS. 6*b* to 6*c*, in the preferred example described here, two evenly distributed pins 54 are provided on each radial fin 34, the pins 54 being evenly spaced on each fin 34 between the second and third annular rings 28, 32. A third pin 56 is provided at each intersection between a radial fin 34 and the shallower portions of the third annular ring 28, i.e. the portions of the third annular ring 28 having a thickness of t/2 in the example described.

As seen in FIG. 5*c*, in the preferred example shown, a first distance $d_1$ from the second surfaces 41 of the fins 34 to an end 57 of the pins 54, 56 removed from the first surface of the fins 34 is equal to a second distance $d_2$ from the second surface 19 of the plate 20 to the first surface 25 thereof.

As seen in the drawings, the main body 10 of the heat exchanger 2 is formed of a matrix of the plates 20 stacked adjacent to one another on the longitudinal axis A-A and joined together by brazing. When joined together, the plates form the first 58, second 60 and third 62 fluid flow passages of the heat exchanger main body 10. The first fluid flow passage 58 is split into sections formed between the central circular portions 22, the first annular rings 26 and the radial fins 24 of the joined together plates 20. (As each of these elements has a thickness of t, longitudinally adjacent elements will be in contact with one another when the plates 20 are stacked together in use and so will be joined together by the brazing process). Thus, for example, after brazing, the first annular rings 26 of the stacked plates 20 will form a continuous cylindrical wall.

The second fluid flow passage 60 is formed between the first annular rings 26 and the second annular rings 28 of the joined together plates 20. (As each of these elements has a thickness of t, longitudinally adjacent elements will again be in contact with one another when the plates 20 are stacked together in use and so will be joined together by the brazing process).

The third fluid flow passage 62 is formed between the second annular rings 28, the third annular rings 32 and the first and second substantially semi-circular rims 36, 46 of the joined together plates 20. It will be understood that those parts of the third annular rings 32 having a thickness of t/2 will provide gaps through which fluid may flow when the plates 20 are assembled. Longitudinally adjacent second annular rings 28, those parts of the third annular rings having a thickness oft and the first and second substantially semi-circular rims 36, 46 will again be in contact with one another in the assembled heat exchanger to form continuous walls of the third fluid flow passage 62.

It will be understood from the above that by joining adjacent surfaces of elements of the stacked plates 20 together by hard brazing, a fluid tight seal between the surfaces thereof may be achieved so as to provide fluid tight flow passages within the heat exchanger main body 10.

It will further be understood that the first flow passage 58 is internal of the second flow passage 60 and is separated therefrom by the first annular rings 26 (or a dividing wall having a desired shape in alternative examples). The second flow passage 60 is internal of the third flow passage 62 and is separated therefrom by the second annular rings 28 (or a dividing wall having a desired shape in alternative examples). Thus, the second flow passage 60 extends around the first flow passage 58 and the third flow passage 62 extends around the second flow passage 60.

In use, a first fluid flows from the first inlet 4 in the first tank 12 into the first fluid flow passage 58 in a first direction parallel to the longitudinal axis AA of the heat exchanger 2 to a first outlet 64 in the second tank 16. The second fluid flows from the second inlet 6 in the second tank 16 into the second fluid flow passage 60. It will be understood from the description above that the second fluid flow passage 60 extends around and parallel to the first fluid flow passage 58. The second fluid flows through the second flow passage 60 in a direction opposite to the direction of flow of the first fluid to reach a second outlet 66. The provision of opposite flow directions in the first and second fluid flow passages 58, 60 may improve the heat exchange capacity of the heat exchanger 2.

The third fluid flows from the third inlet 8 provided in the first tank 12, in the first direction parallel to the longitudinal axis AA of the heat exchanger 2, into the third fluid flow passage 62 on the side of the first semi-circular rim 36. It will be understood that the third fluid can flow from the area inside the first semi-circular rim 36 into the area between the third and second annular rings 32, 28 through gaps between the adjacent portions of the third annular rings 32 having a thickness of t/2. The third fluid will then flow around the second annular rings 28 to exit into the area inside the second semi-circular rims 40 by passing through gaps between the adjacent portions of the third annular rings 32 having a thickness of t/2. The third fluid will then flow in the second direction opposite to the first direction through the passage formed internally of the second semi-circular rims 40 to exit via a third outlet (not shown) provided in the first tank 12.

It will be understood that in use, heat will be exchanged between the first and second fluid flows via the dividing wall formed by the joined together first annular rings 26 of the stacked plates 20. The radial fins 24 will act to increase the secondary surface area for heat exchange. Further, in the preferred example shown, the undulating or twisted form thereof will act to produce a turbulent flow in the first fluid flow passage 58, thus increasing heat exchange capacity.

It will be understood that pressure relief valves (not shown) may be provided at the fluid inlets and/or outlets as required.

It will be appreciated that the walls of the heat exchanger 2 in the example shown have curved edges. Further, every join between surfaces in each plate 20 (for example, between a fin and an annular ring) may be rounded. This results in improved strength and durability due to reduction in crack propagation risk.

To form the heat exchanger 2, a desired number of plates 20 of for example from 6 to 120 plates, or more preferably from 10 to 40 plates, are stacked on top of one another so as to be axially aligned and are joined together by being hard brazed and compressed together at a high temperature. In one preferred example as shown, the heat exchanger 2 may comprise 20 plates. During production, means such as visual sensors (not shown) may be used to verify the placement and correct order of the plates prior to brazing them together. In one preferred example, the visual sensors may comprise rectangular or semi-circular shapes etched into the radially outer surface of the third annular rings 32 of the plates 20. During assembly on a jig, the visual sensors may be used to correctly align the plates 20 as they are stacked, for example by forming a V from the aligned rectangular shapes. They also allow for the number of plates on the jig to be counted more easily than would otherwise be possible. It will be understood that any other suitable method of joining the plates together could also be used such as for example, diffusion bonding or welding.

When joined together, the plates 20 form the heat exchanger main body 10 as described above. The use of plates 20 joined together, for example by brazing, provides good sealing between the first, second and third flow passages 58, 60, 62.

In one example of use of a heat exchanger according to the present disclosure, cold oil may be inserted into the second flow passage 60 to be heated by hot air from a turbine stage of an aircraft engine, the hot air flowing through the first flow passage 58. Cold air may be passed through the third flow passage 62 to be heated and used for warming the edge of an aircraft wing. Alternatively, fuel to be heated before being combusted in a turbine engine can be passed through the third flow passage 62.

An advantage of the heat exchanger of the present invention is that the direction of heat exchange between the fluids in the heat exchanger 2 can be altered during the working cycle of the heat exchanger 2. It will be understood that the direction of heat exchange will depend on the relative heat or energy of each fluid in the heat exchanger 2. This will be affected by the inlet temperature of each fluid, the volumetric flow of each fluid, the temperature difference between each of the fluids and the thermal conductivity of each fluid. If the fluid in the second flow passage 60 has a higher energy level than the other two fluids, it will act to heat the fluids in both the first 58 and third 62 flow passages. If the fluid in the second flow passage 60 has a lower energy level than the other two fluids, it will be heated by the fluids in both the first 58 and third 62 flow passages. If the fluid in the second flow passage 60 has an energy level between that of the other two fluids, it will act to heat the fluid in one of the first 58 and third 62 flow passages and to cool the fluid in the other of the first 58 and third 62 flow passages.

The possibility of varying the direction of heat exchange could be useful for example in aerospace applications for gas turbine engines. For example, hot bleed air could be provided to the first flow passage 58. Generator oil could be provided to the second passage 60 and fuel requiring to be heated prior to combustion in the gas turbine engine could be provided to the third flow passage 62. When the engine first starts operating, it is necessary to heat the generator oil to reduce the resistance of the main engine rotor. After this however, the generator oil is required to be cooled. By varying the rate of flow of fuel in the third flow passage 62 it is possible to achieve the required effect of initially heating the generator oil but then cooling it after a predetermined time has elapsed.

It will be understood that when used in an engine, the space available for a heat exchanger may be limited and may also be an irregular shape. The heat exchanger according to the present disclosure allows a shape to be created which can be fitted to the available space, for example by varying the shape of successive plates stacked in the heat exchanger matrix. For example therefore, the heat exchanger could be designed to take a banana-type shape to fit with an engine nacelle and also to be circular in cross section.

A further advantage of the heat exchanger of the present disclosure is that the drop in pressure of the first, second and/or third fluids in use may be relatively low compared to know heat exchangers. This is because the drop in pressure will be a function of the possible flow area (i.e. the area in which flow is not blocked) and the length of the heat exchanger. The structure of the heat exchanger of the present disclosure provides a greater possible flow area than would be provided for example in a heat exchanger using known plate fin technology in which flow is often blocked by corrugations.

It will be appreciated by those skilled in the art that the present disclosure has been illustrated by describing one or more specific examples thereof, but is not limited to these examples; many variations and modifications are possible, within the scope of the accompanying claims.

For example, although the structure described above includes three fluid flow passages, it will be understood that the structure could be modified to include four or more fluid flow passages to allow for heat exchange between four or more separate fluid flows. Further, the shape and number of the various flow passages and of the fins and pins within the various flow passages could be varied as required.

The invention claimed is:

1. A plate for use in a heat exchanger, the plate comprising:

a first surface;

a second surface extending parallel to and spaced from the first surface;

first, second and third discrete flow passages passing through the plate from the first surface to the second surface, the second flow passage extending around the first flow passage and the third flow passage extending around the second flow passage;

a plurality of fins extending parallel to the first surface across the third flow passage and having a first fin surface extending parallel to the first surface of the plate and a second fin surface extending parallel to and spaced from the first fin surface; and one or more pins protruding from the first fin surface of at least some of the fins, the pins extending away from the second fin surfaces, wherein a first distance from the second fin surfaces to an end of the pins removed from the first fin surfaces is less than or equal to a second distance from the second surface of the plate to the first surface thereof.

2. A plate as claimed in claim 1, further comprising a solid central portion extending from the first surface to the second surface, wherein the first flow passage extends around the solid central portion.

3. A plate as claimed in claim 2, further comprising a plurality of second fins extending across the first flow passage from the solid central portion towards the second flow passage.

4. A plate as claimed in claim 3, wherein the second fins have an undulating form.

5. A plate as claimed in claim 1, wherein the pins are twisted in a direction perpendicular to the direction of the flow of fluid through the third flow passage in use.

6. A plate as claimed in claim 1, the third flow passage comprising a gap formed by a wall extending outwardly of and around the second flow passage, and first and second outer portions formed by walls extending outwardly from the wall and re-joining therewith on either side thereof, wherein the sections of the wall which are internal of the first and second outer portions extend over a third distance which is less than the second distance from the first surface to the second surface of the plate, and the other sections of the wall and the walls extending outwardly from the wall on either side thereof extend from the first surface to the second surface of the plate.

7. A plate as claimed in claim 1, wherein the plate is formed by etching, additive manufacturing, 3D printing or powder metallurgy.

8. A heat exchanger body comprising a plurality of plates as claimed in claim 1, wherein the plates are arranged adjacent to one another along a longitudinal axis (A-A) of the heat exchanger body such that the first surface of a first plate is in contact with the second surface of an adjacent plate, and the first, second and third flow passages of adjacent plates are joined together to form continuous first, second and third flow passages extending through the heat exchanger body.

9. A heat exchanger body as claimed in claim 8, further comprising:

a first inlet to the first flow passage provided at a first longitudinal end of the heat exchanger body and a first outlet from the first flow passage provided at a second longitudinal end of the heat exchanger body; and a second inlet to the second flow passage provided at the second longitudinal end of the heat exchanger body and a second outlet from the second flow passage provided at the first longitudinal end of the heat exchanger body such that in use, fluid will flow through the second flow passage in a direction opposite to the direction of flow of fluid through the first flow passage.

10. A heat exchanger body as claimed in claim 9, further comprising:

a third inlet to the third flow passage provided at the first longitudinal end of the heat exchanger body and a third outlet from the third flow passage provided at the first longitudinal end of the heat exchanger body.

11. A heat exchanger body as claimed in claim 10, wherein the third inlet is provided on a first side of the heat exchanger body and the third outlet is provided on a second opposite side of the heat exchanger body such that in use, fluid will flow through the third flow passage in the first longitudinal direction on the first side of the heat exchanger body, flow around the second passage in a direction perpendicular to the first longitudinal direction and then flow to the third outlet in the second longitudinal direction on the second side of the heat exchanger body.

12. A method of exchanging heat between fluid flows, the method comprising:

passing a first fluid flow in a first direction through the first continuous flow passage extending through the plurality of plates in the heat exchanger body as recited in claim 8;

passing a second fluid flow in a second direction opposite to the first direction through the second continuous flow passage, the second continuous flow passage extending around the first continuous flow passage and through the plurality of plates in the heat exchanger body; and passing a third fluid flow through the third continuous flow passage, the third continuous flow passage extending around the second continuous flow passage and through the plurality of plates in the heat exchanger body.

13. A method of manufacturing a heat exchanger, the method comprising:

forming a plurality of plates as claimed in claim 1; and stacking the plurality of plates one above the other in a desired configuration so as to align the first, second and third flow passages in the plurality of plates.

14. A method of manufacturing a heat exchanger as claimed in claim 13, further comprising:

joining the plates together by brazing.

15. A method as claimed in claim 14, wherein the plurality of plates vary in shape and are stacked so as to form a heat exchanger body having an irregular shape.

* * * * *